US005217117A

United States Patent [19]

Tsuji

[11] Patent Number: 5,217,117

[45] Date of Patent: Jun. 8, 1993

[54] PLANT PACKING CONTAINER FOR RETAINING PLANT FRESHNESS

[75] Inventor: Ryoji Tsuji, Tokyo, Japan

[73] Assignee: Starlanes Corporation, Tokyo, Japan

[21] Appl. No.: 851,292

[22] Filed: Mar. 12, 1992

[30] Foreign Application Priority Data

Sep. 3, 1991 [JP] Japan ..... 3-70399

[51] Int. Cl.[5] ..... B65D 85/52

[52] U.S. Cl. ..... 206/423; 206/205; 47/84

[58] Field of Search ..... 206/45.19, 205, 423, 206/443, 486; 47/84

[56] References Cited

U.S. PATENT DOCUMENTS

| | | | |
|---|---|---|---|
| 536,908 | 4/1885 | Bailey | 206/423 |
| 1,601,625 | 9/1926 | Hrudy | 206/205 |
| 2,348,488 | 5/1944 | McLellan et al. | 206/423 |
| 2,358,295 | 9/1944 | Bacigalupi | 206/423 |
| 3,754,642 | 8/1973 | Stidolph | 47/84 |
| 3,883,990 | 5/1975 | Stidolph | 206/423 |
| 3,973,356 | 8/1976 | Schacht | 206/423 |
| 4,113,093 | 9/1978 | Hendrickx | 206/423 |
| 4,118,890 | 10/1978 | Shore | 47/84 |
| 4,170,301 | 10/1979 | Jones et al. | 47/84 |
| 4,936,046 | 6/1990 | Miller | 206/423 |
| 5,038,930 | 8/1991 | Holtkamp, Jr. | 206/423 |

*Primary Examiner*—David T. Fidei

*Attorney, Agent, or Firm*—Wenderoth, Lind & Ponack

[57] ABSTRACT

A plant packing container for retaining plant freshness has a flexible waterproof sheet laid on the bottom of a container body. An upper sheet overlays the flexible waterproof sheet and covers almost the entire bottom of the container body. The upper sheet retains moisture between the flexible waterproof sheet and itself. The stems of flowers or plants to be transported are inserted through perforations formed in the upper sheet to maintain the relative positions of the flowers or plants during transport. The flexible waterproof sheet is then folded over and wrapped around the plants held by the upper sheet. The packing container maintains an appropriate internal humidity level and minimizes factors which can cause the flowers or plants to be cut or spoiled during transportation.

8 Claims, 1 Drawing Sheet

PLANT PACKING CONTAINER FOR RETAINING PLANT FRESHNESS

BACKGROUND OF THE INVENTION (1) Field of the Invention

The present invention relates to a packing container for retaining plant freshness to be used in the transport of fresh cut flowers and fresh cut plants.

(2) State of the Prior Art

Until now, fresh flowers and fresh cut plants (hereinafter generically referred to as just "cut flowers") have been transported in a packed state in packages or containers while being transported domestically or imported and exported between Japan and other countries. However, because of the delicate nature of cut flowers, usually the cut flowers are packed together with large amounts of randomly placed waste paper filler for retaining the shape and humidity of the flowers. The flowers are buried in the waste paper filler after which water is sprayed from above until the contents are sufficiently moist. Alternatively, when moisture is particularly important, devices known as water-caps are used to cover the cut portion of the flower stems.

The above-described known packing methods have several drawbacks. For example, these methods can cause flowers buried in the waste paper filling to become pressed together, bruised, scraped or broken, and they often will have bits of the waste paper attached when removed from the packing. Moreover, although the paper filler functions as a protective buffer, adding sufficient water to maintain the necessary humidity results in the package becoming extremely heavy and unwieldy, requiring the packing container to be reinforced.

Further, the existing packing methods require that part of the paper filling be removed in order to confirm the contents and condition of the flowers during transport, and this handling of the packing material can cause the flowers to become bruised. This presents a major problem in the case of importation of flowers from abroad, where plant quarantine regulations require customs to visually inspect the flowers.

SUMMARY OF THE INVENTION

The object of the present invention is to provide a packing container for the transport of fresh cut flowers and plants that is constructed in a manner so as to retain the appropriate humidity conditions while minimizing factors that cause the flowers to deteriorate during transport so that the flowers will retain their freshness during transport without becoming spoiled.

Specifically, the present invention provides a packing container for plants which comprises a container having a bottom and a removable lid. A flexible waterproof sheet is placed on the interior surface of the bottom of the container, and a planar upper sheet overlays the waterproof sheet. The planar upper sheet is made of a material that is capable of maintaining the planar form thereof so that the upper sheet will not become easily rumpled, the upper sheet further covering substantially the entire bottom of the container. Perforations are formed in the upper sheet for the purpose of holding plant materials such as flower stems.

The upper sheet is spaced from the flexible waterproof sheet by the presence of the plant materials to form a moisture retaining space therebetween. The perforations are preferably regularly spaced in the longitudinal direction of the container. Further, the upper sheet can be affixed to the flexible waterproof sheet for the purpose of maintaining the relative positions of the sheets inside the container. The upper sheet should be made of a suitable material, such as a highly foamed, non-crosslinked, polyethylene sheet, a non-rigid vinyl chloride sheet, a polyethylene film, a foamed styrol, or other material or materials having similar characteristics.

The flexible waterproof sheet can be made of any one of numerous available flexible plastic film materials. The waterproof flexible sheet should be substantially larger than the upper sheet so that the flexible waterproof sheet can be folded around the upper sheet and the plant materials held therein so as to completely cover the upper sheet to retain the moisture in the container. The flexible waterproof sheet is also preferably transparent to enable the plant materials or flowers held in the container to be easily viewed.

The container itself is preferably a rectangular box-shaped container made of paper or wood.

The present invention further contemplates a method of packing plant materials which includes the steps of providing the container having the bottom with an interior surface and the removable lid, placing the flexible waterproof sheet on the interior surface of the bottom, and placing the upper sheet over the waterproof sheet so as to substantially cover the entire interior surface of the bottom and forming a plurality of perforations through the upper sheet. Plant materials are inserted through the perforations of the upper sheet so that the plant materials extend therethrough. The flexible waterproof sheet is folded over the upper sheets so as to cover the plant materials, and the container is closed with the removable lid.

The upper sheet, as noted above, is spaced from the flexible waterproof sheet by the plant materials to form a moisture retaining space therebetween. The plant materials have their stems extending through the upper sheet into the moisture retaining space. Preferably water is sprayed onto the flexible waterproof sheet before the upper sheet is placed over the flexible waterproof sheet.

The perforations can be formed in the upper sheet either before the upper sheet is placed over the waterproof sheet or at the point in time when the flowers are going to be inserted into the upper sheet. The upper sheet can be perforated with more holes therein than flowers or plant materials to be inserted therethrough. The stems of the flowers or plant materials can then be inserted through the holes selectively so as to result in the flowers being appropriately spaced according to their size.

The plant materials may also be sprayed with water after they have been inserted through the perforations of the upper sheet.

BRIEF DESCRIPTION OF THE DRAWINGS

Further objects, features and advantages of the present invention will become apparent from the following description taken in conjunction with the accompanying drawings, wherein.

DETAILED DESCRIPTION OF THE PREFERRED EMBODIMENT

Figure 1:
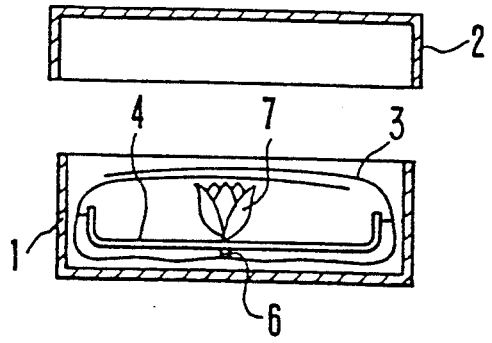
FIG. 1 is a cross-sectional side view of a plant packing container according to the present invention with the lid thereof removed.
Figure 2:
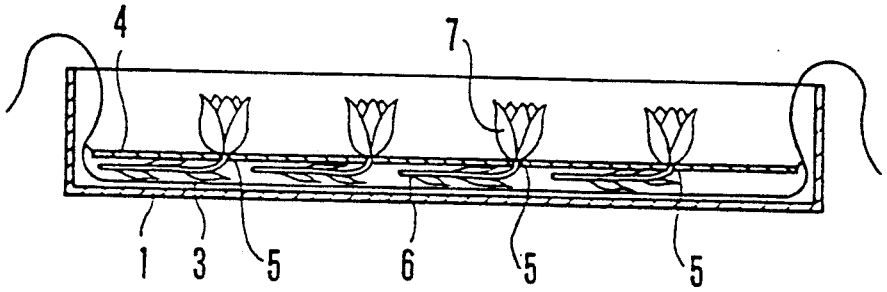
FIG. 2 is a cross-sectional front view of the plant packing container of FIG. 1.
Figure 3:
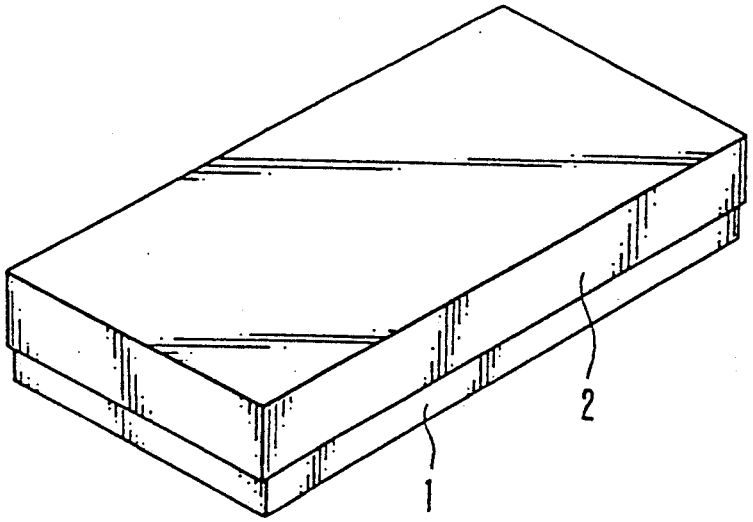
FIG. 3 is a perspective view of the plant packing container of FIGS. 1 and 2 in an assembled form.

A packing container 1, preferably a rectangular box-shaped container, is illustrated in FIG. 1 with a lid 2 thereof being removed. The container 1 is preferably made of paper or wood. As illustrated in the figures, the removable lid 2 fits over the bottom portion of the container 1, the container 1 having a longitudinal axis along which a row of flowers 7 extends.

A flexible waterproof sheet 3, or packing sheet, is placed on the bottom of the container 1. As can be seen from the figures, the sheet 3 is chosen at a size sufficient to wrap around flowers packed in the container 1 by folding the sides of the flexible waterproof sheet 3 back on itself.

Water is then sprayed onto the flexible waterproof sheet 3 until water droplets form at the center portion of the sheet 3. An upper sheet or insertion sheet 4 is then placed on top of the flexible waterproof sheet 3. The upper sheet 4 is of a sufficient size to cover substantially the entire bottom of the packing container 1 so as to prevent movement of the container contents during transportation. In addition, the upper sheet 4 could be affixed to the packing sheet 3 by means of two-sided adhesive tape or riveting, as at reference number 8, to maintain the relative positions between the waterproof sheet 3 and the insertion sheet 4. Preferably the upper sheet 4 is made of a material capable of maintaining a substantially planar form so that the upper sheet 4 will not become easily rumpled in use. For example, the upper sheet 4 is preferably made of a material such as a highly foamed, non-crosslinked, polyethylene sheet, a non-rigid vinyl chloride sheet, a polyethylene film, or a foamed styrol.

A number of perforations 5 are formed at fixed positions in the upper sheet 4 for holding plant materials. Each perforation should have a diameter approximately equal to or slightly larger than the thickness of the stem of the flowers or plant materials to be transported. Further, the positions of the perforations should be such that the flowers or plant materials, with the stems inserted through the perforations, will be adjacent to one another without contacting one another. The number of perforations should be at least in the amount of the number of flowers or plant materials to be transported, but could be in a greater amount to allow for adjustment of the positions of the plant materials in the container.

The perforations 5 can either be made in the upper sheet 4 at the time of insertion of the flowers or plant materials, or the perforations 5 could be made prior to the upper sheet 4 being placed in the container 1.

After the flexible waterproof sheet 3 and the upper sheet 4 are placed in the container 1, a stem 6 of a flower 7, such as an anthurium, is pressed through a perforation 5 in the upper sheet 4. Water is then sprayed on the flowers in a sufficient amount to produce droplets on the surface of the flowers 7. At this point in the process of assembling the packing container, the upper sheet 4 may be bonded to the flexible waterproof sheet 3 by the two-sided adhesive tape or riveting as described above, if so desired.

The sides of the flexible waterproof 3 are then folded over each other to reduce air circulation in the packing container and to maintain an appropriate internal humidity during transportation of the container. The packing container is finished by placing the removable lid 2 on top of the container bottom and sealing the container 1 with adhesive tape.

In one preferred feature of the present invention, the flexible waterproof sheet 3 may be transparent. This provides an advantage in that the packing container 1 can then be used as a display case for exhibiting the flowers after transportation.

Further, if customs is required to visually inspect the flowers in the container 1, by the use of a transparent flexible waterproof sheet 3, only the lid 2 need be removed in order to visually inspect the flowers 7.

In a further alternative feature of the present invention, cup-shaped receptacles could be employed with the upper sheet 4, either placed on the upper sheet 4 or formed as a single integral unit together with the upper sheet 4 of the foamed styrol. These cup-shaped receptacles can then be used to receive and protect particularly delicate and expensive flowers.

By the use of the present invention, a first advantage is provided in that the spoilage of flowers, common when flowers are transported using the traditional paper filler method, is avoided. Flowers are transported by the present invention in their natural condition, with little breakage or bruising and with no attached paper filling when the flowers are removed from the packing container.

Furthermore, the cost of transporting the flowers is lowered by reducing the amount of work necessary for preparing and packing the flowers. An amount of moisture suitable to the type and number of flowers to be transported is provided to the flowers and stem areas of the container, this preserving the freshness of the flowers without the need for attaching water-caps to the cut stems.

In addition, the waste paper filling traditionally used in the transport of flowers absorbs moisture. Thus, once the waste paper filling is wet, the packing container becomes heavy and unwieldy and it becomes necessary to reinforce the container. In the present invention, the waterproof sheets do not absorb moisture, so less water is used, resulting in a more lightweight packing process.

The packing of the present invention, it is further noted, is composed of only the box container body and the plastic sheets. Thus once the lid is removed from the bottom, the flower contents can be seen directly (if a transparent flexible waterproof sheet is used), or directly after lifting aside the flexible waterproof sheet (when using an opaque flexible waterproof sheet). In contrast, traditional packing methods, when confirmation of the contents of the plant packing container is required, as for example in import/export transactions, and particularly when plant quarantine regulations call for mandatory customs inspection, require the unpacking of every flower or plant in the packing container, and then repacking each item. With the present invention, the same confirmation of the container contents can be made simply by removing the container lid and lifting aside the sides of the flexible waterproof sheet, thus greatly simplifying the inspection operations and reducing the risk of flower damage.

I claim:

1. A packing container for plants, comprising:

a container having a bottom and a removable lid;

a flexible waterproof sheet placed on the interior surface of said bottom of said container; and a planer upper sheet made of a material capable of maintaining the planar form thereof overlaying said waterproof sheet and covering substantially the entire said bottom of said container, said upper sheet having perforations therein for holding plant materials;

wherein said upper sheet is affixed to said flexible waterproof sheet, wherein said flexible waterproof sheet is transparent, and wherein said flexible waterproof sheet is substantially larger than said upper sheet such that said flexible waterproof sheet is capable of being folded around and over said upper sheet so as to completely cover said upper sheet.

2. The packing container of claim 1, wherein said container is rectangular, with a longitudinal axis, and said upper sheet has said perforations therein regularly spaced in the longitudinal direction of said container.

3. The packing container of claim 1, wherein said upper sheet is made of a material selected from the group consisting of a highly foamed non-crosslinked polyethylene sheet, a non-rigid vinyl chloride sheet, a polyethylene film and a foamed styrol.

4. The packing container of claim 1, wherein said container has sidewalls connected to said bottom.

5. The packing container of claim 1, wherein said container is rectangular, box-shaped and made of one of wood and paper.

6. A packing container for plants, comprising:

a container having a bottom and a removable lid;

a flexible waterproof sheet placed on the interior surface of said bottom of said container; and a planar upper sheet made of a material capable of maintaining the planar form thereof overlaying said waterproof sheet and covering substantially the entire said bottom of said container, said upper sheet having perforation therein for holding plant materials;

wherein said upper sheet is affixed to said flexible waterproof sheet, wherein said flexible waterproof sheet is transparent and wherein said flexible waterproof sheet defines a means for completely covering said upper sheet and retaining moisture by having a size substantially lager than said uppers sheet and by being folded around and over said upper sheet.

7. The packing container of claim 6, wherein said container is rectangular, with a longitudinal axis, and said upper sheet has said perforations therein regularly spaced in the longitudinal direction of said container.

8. The packing container of claim 6, wherein said upper sheet is made of a material selected from the group consisting of a highly foamed non-crosslinked polyethylene sheet, a non-rigid vinyl chloride sheet, a polyethylene film and a foamed styrol.

* * * * *